United States Patent [19]

Stahl

[11] 4,118,145

[45] Oct. 3, 1978

[54] WATER-COOLED TURBINE BLADE

[75] Inventor: William F. Stahl, Media, Pa.

[73] Assignee: Westinghouse Electric Corp., Pittsburgh, Pa.

[21] Appl. No.: 773,461

[22] Filed: Mar. 2, 1977

[51] Int. Cl.[2] ..... F01D 5/18

[52] U.S. Cl. ..... 416/96 R; 416/97 R

[58] Field of Search ..... 416/95–97

[56] References Cited

U.S. PATENT DOCUMENTS

| | | | |
|---|---|---|---|
| 2,883,151 | 4/1959 | Dolida | 416/96 |
| 3,816,022 | 6/1974 | Day | 416/97 |
| 3,844,679 | 10/1974 | Grondahl et al. | 416/95 X |
| 3,849,025 | 11/1974 | Grondahl | 416/96 X |
| 3,902,819 | 9/1975 | Holchendler et al. | 416/97 X |

*Primary Examiner*—Everette A. Powell, Jr.
*Attorney, Agent, or Firm*—F. A. Winans

[57] ABSTRACT

A gas turbine blade is shown having channels subjacent the surface for a coolant to flow therethrough from a radially inner inlet to a discharge port adjacent the blade tip. The channels include intermediate enlarged chambers wherein a portion of the coolant is permitted to vaporize, so that the smaller diameter coolant distributing channels remain substantially liquid full. The vapor from the chambers is exhausted at a position radially inwardly of the blade tip and preferably below the blade platform.

5 Claims, 1 Drawing Figure

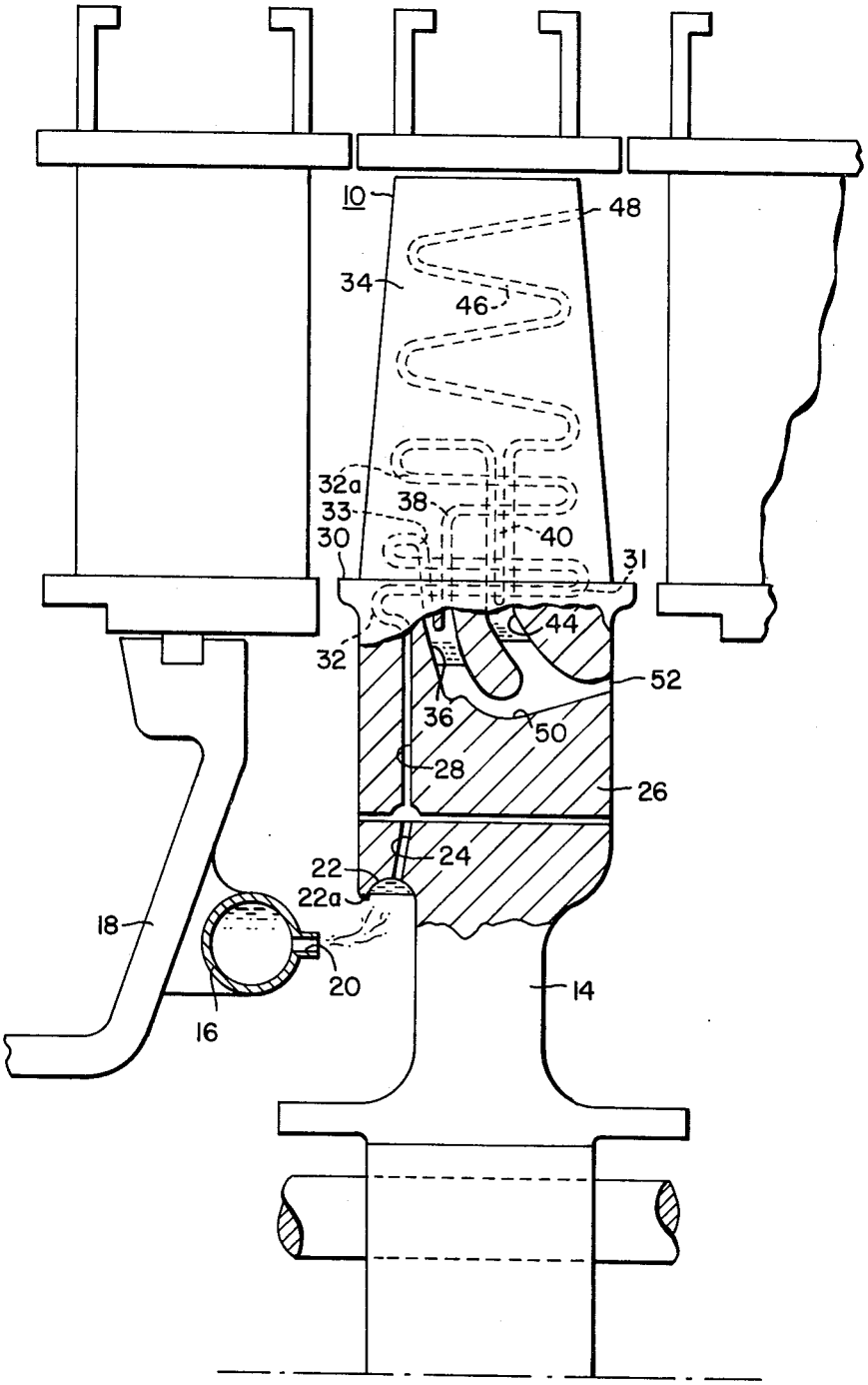
10
48
34
46
32a
38
33
40
30
31
44
32
52
36
50
28
26
24
22
22a
18
20
14
16

WATER-COOLED TURBINE BLADE

BACKGROUND OF THE INVENTION

1. Field of the Invention

This invention relates to cooled gas turbine blades and more particularly to a blade having a liquid coolant flowing through fluid distributing channels subjacent the surface of the blade.

2. Description of the Prior Art

Liquid, i.e., water, cooled gas turbine blades are shown in U.S. Pat. Nos. 3,804,551 and 3,736,071. In these patents water enters the blade adjacent the blade root and is exhausted at the blade tip as a mixture of steam and water. However, it is recognized that the presence of steam in heat transfer tubes, such as the channels distributing the coolant through the blade, substantially reduces the ability of the water within the channels to absorb the heat from the surrounding structure. This is because the steam produces pockets or voids in the water that prevents the water from wetting the walls of the passages and absorbing the heat therefrom.

U.S. Pat. No. 3,902,819 shows another cooled turbine blade, and in an attempt to overcome the above deficiency, maintains the water at a super critical pressure so that it cannot pass through the phase change to steam, thereby remaining liquid and in intimate heat transfer contact with the walls of the channels. However, this reduces substantially the amount of heat that can be absorbed by the liquid if permitted to change phase from water to steam, which heat must come from the surrounding blade structure thereby cooling it. Thus the advantages obtained within a cooling system by permitting a phase change and thereby increasing the cooling capability of the water have heretofore been negated by subsequent decrease in heat transfer rates due to the vapor generated by the phase change subsequently interfering with heat transfer into the remaining liquid flowing through the coolant channels, and elimination of the phase change of the coolant from liquid to vapor likewise reduces the coolant's capacity to absorb heat.

SUMMARY OF THE INVENTION

The present invention is similar to the first two previously identified patents in that the coolant fluid is introduced at the blade root and flows outwardly to be exhausted as a mixture of steam and liquid at the blade tip. However, as the coolant flows through the channels it is periodically passed into an enlarged volume or chamber generally in the central portion of the blade where at least a portion of it is vaporized, either by flashing to steam or by boiling. The steam or vapor from such cavity, being less dense than the liquid coolant, is separated from the liquid and exhausted at a radially inwardly position, preferably below the blade platform. However, the more dense liquid re-enters radially outwardly directed coolant distributing channels projecting from the chamber and, under the influence of the centrifugal force is ultimately delivered to the blade tip to be exhausted therefrom through a discharge port. The final passage of the cooling fluid from the final chamber to the discharge port at the blade tip is maintained substantially liquid-filled due to the increasing pressure in the fluid caused by the centrifugal force which increases as the cooling fluid moves radially outwardly. Thus the final channel is also substantially free of vapor pockets that otherwise inhibit the heat transfer to coolant.

BRIEF DESCRIPTION OF THE DRAWINGS

FIG. 1 is an elevational view of an axial portion of a gas turbine engine generally schematically showing a typical cross-sectional view of the blade of the present invention.

DESCRIPTION OF THE PREFERRED EMBODIMENT

Referring to FIG. 1, the cooled gas turbine blade 10 of the present invention is shown as mounted in the rotor 14 of a gas turbine engine. The preferred coolant for the blade is water which is delivered to the blade by a water supply manifold 16 mounted on the diaphragm 18 and having nozzles 20 for injecting water towards the rotor 14 for collection in the gutter 22 formed therein by a downturned annular lip **22*a*. A coolant delivery passage 24 extends from the cusp portion of the gutter to root 26 of each blade 10 in alignment with a radially extending coolant delivery passage 28 in the root and extending generally radially to subjacent the platform portion 30 of the blade 10**.

It is noted that the radial passage 28 terminates subjacent the platform portion 30 with the coolant distributing channel 32 continuing from the termination of passage 28 being configured or distributed in any preferred form such as a spiral-like path or a serpentine path having major axially or major radially extending legs. In the embodiment shown, the distributing channel 32 is serpentine with axially extending major paths **32*a***. It is to be understood that such channels are formed just under the surface of the blade and that the core of the blade can, if desired, be hollow.

The initial path 31 of the coolant distributing channel 32 traverses the platform portion 30 of the blade and ultimately leads into a radially inner portion of the airfoil section 34 of the blade structure, to some preferred radial distance above the platform 30 from whence the final leg 33 thereof is directed generally radially inwardly to a first enlarged chamber or cavity 36 which is radially inwardly of the platform 30. This entry to the chamber 36 is at the radially outermost portion thereof and the outlet from the chamber 36 to an intermediate coolant channel path 38 extends radially outwardly from adjacent the initial passage inlet to continue the coolant distributing passage configuration to yet another radially outwardly position, with this intermediate path 38 likewise terminating in a radially inwardly extending leg 40 in communication with a second enlarged chamber 44 generally radially outwardly of the first chamber 36 but still in the vicinity subjacent the blade platform 30. The intermediate passage 38 discharges into a radially outer portion of the chamber 44 and a final coolant path 46 extends from adjacent this point to continue the coolant passage configuration to finally exit the blade from an exhaust port 48 on the downstream trailing edge adjacent the blade tip.

The first and second enlarged chambers 36 and 44 respectively are in communication with a common exhaust channel 50 leading to a discharge 52 in the downstream facing surface of the root portion of the blade. It is noted that both cavities 36, 44 have walls which are angled in the discharge direction for a reason to be explained later.

In operation, water is supplied to the gutter 22 from the supply manifold 16 and, under the influence of centrifugal force, moves through the passage 24 in the rotor to be fed into the passage 28 in the root portion 26 of the blade from whence it flows into the initial path 31 of the coolant distributing channels 32.

The water flowing through this confined coolant channel 31 absorbs heat from the surface of the channel contacted thereby and becomes heated to an elevated temperature. It then flows radially inwardly, (against the centrifugal force) as forced by the pressure head in the initial portion of the channel, i.e., passage 28 and the initial portion of channel 31, and into the first chamber 36. In this chamber, depending upon the heat content or temperature of the water and the pressure, the heated water either provides some flashing into steam or, because of the rather strong centrifugal force field, the water in the reservoir formed by the chamber establishes thermal currents whereby the warmer, less dense water rises to the top (i.e. moves radially inwardly) providing surface vaporization and the cooler water moves to the radially outer portion for discharge into the intermediate coolant channel 38.

The rearwardly angled walls of the chamber 36 (and likewise subsequent chamber 44) aids the separation of the water therein according to its relative density by centrifugal force which has a greater effect on the more dense or cooler water thereby causing the warm water to be displaced to a radially inwardly position with the angled walls establishing a definite direction for the flow of the water to achieve this separation in a definite circulation pattern forming thermal currents in the water. This pattern eliminates otherwise random currents that would cause sufficient mixing of the warmer and cooler water so that no separation by density could occur, which would also impede surface vaporization of the water.

Thus, with the more dense cooler water adjacent the inlet to the intermediate cooling channel 38, the centrifugal force pumps water therethrough in the configuration of the intermediate cooling channels to continually absorb and transport heat from the airfoil portion of the blade. Again, because of the radially outer position of the intermediate channels, water is at an elevated pressure and does not tend to vaporize while in the confined channels. However, after passing through the intermediate cooling channels the water is again discharged into the next chamber 44 for vaporization as in the initial chamber 36. It is noted that the respective chambers are offset from one another a radial distance so that the pressure head in the intermediate coolant channels is sufficient to return the water radially inwardly against centrifugal force to the next chamber 44 considering frictional losses and also considering a less dense liquid (because it is heated), on the incoming portion.

As before, the coolant channel continues from chamber 44 generally adjacent the inlet to the chamber, i.e. at the radially outermost portion, to receive therein the more dense cooler liquid, and, as shown in FIG. 1, ultimately leads to the discharge opening 48 in the downstream edge adjacent the blade tip. Because of the generally radially outer position of this last portion of the coolant channel 46, the increased pressure due to increased centrifugal force generally inhibits a phase change in the coolant so that for the most part even this portion of the coolant channel remains substantially liquid-full. However, it is expected that a mixture of liquid and vapor will ultimately be exhausted into the gas path from the discharge port.

Further it is apparent that should the temperature to which the blade is subjected require it, other enlarged chambers could be interposed in the coolant channels to permit more of the coolant to change to vapor therein to maintain the channels in an optimum liquid-full condition.

Thus it is seen that the coolant channel configuration of the present invention has the ability to vaporize portions of the water at selected areas in the flow path without the vaporized portion affecting the heat transfer capability of the water flowing in the subsequent downstream portions of the coolant channels in that the vapor is separated and exhausted therefrom at a plurality of intermediate positions. This permits the coolant passages for the most part (i.e., except for a portion of the final passage 46) to operate water full for greater heat transfer capabilities.

Further, as the majority of vaporization is in rather large chambers in the interior of the blade where heat transfer is not particularly critical, any mineral deposits produced by the vaporization of the water will not greatly effect the flow rate of the coolant through the chamber as would be the case if mineral deposits due to vaporization occurred in the main coolant passages, and neither would such deposits deleteriously diminish the heat transfer rate to the coolant as would also be their effect if deposited on any critical heat transfer surface of the coolant passages.

I claim:

1. An improved fluid cooled gas turbine blade having a coolant delivery passage through the blade root in flow communication with coolant flow channels traversing the airfoil portion of the blade subjacent the surface thereof wherein the improvement comprises:

a plurality of enlarged chambers in the blade serially connected by coolant flow channels with each such chamber having at least one coolant channel discharging coolant thereinto and at least another coolant channel removing coolant therefrom, said chamber providing a coolant reservoir for separation of the coolant according to its density to permit vaporization therein of at least a portion of the coolant;

vapor exhaust path means extending from each chamber to a downstream facing blade surface for discharging the vapor generated in each chamber whereby said another coolant channel receives liquid coolant from said chamber substantially free of vapor to optimize heat transfer from the blade to the coolant therein; and, final coolant passage connecting the last of said chambers in said series to an exhaust port generally adjacent the blade tip.

2. Structure according to claim 1 wherein said vapor exhaust path means extending from each chamber have a common outlet generally adjacent the radially innermost portion of the airfoil portion of the blade.

3. Structure according to claim 1 wherein each of said chambers has walls extending generally radially inwardly and angled in the downstream direction to provide walls slanted from the coolant inlet channel to promote thermal currents in the coolant within the chamber.

4. Structure according to claim 3 wherein the coolant channels provide flow communication with the chambers at the radially outermost end thereof and the exhaust path provides flow communication with said chambers at the radially innermost end thereof.

5. Structure according to claim 4 wherein the coolant flow channel connecting said chambers in serial flow communication is in communication with the downstream chamber at a point radially outwardly from its point of communication with the upstream chamber to establish a pressure head under centrifugal force for coolant flow in a direction to ultimately exhaust the coolant through said final passage.

* * * * *